US012649882B2

(12) United States Patent
Stummann et al.

(10) Patent No.: US 12,649,882 B2
(45) Date of Patent: Jun. 9, 2026

(54) LOW TEMPERATURE STABILIZATION OF LIQUID OILS

(71) Applicant: Topsoe A/S, Kgs. Lyngby (DK)

(72) Inventors: Magnus Zingler Stummann, Copenhagen (DK); Jostein Gabrielsen, Rødovre (DK)

(73) Assignee: TOPSOE A/S, Kgs. Lyngby (DK)

( * ) Notice: Subject to any disclaimer, the term of this patent is extended or adjusted under 35 U.S.C. 154(b) by 104 days.

(21) Appl. No.: 18/259,577

(22) PCT Filed: Jan. 17, 2022

(86) PCT No.: PCT/EP2022/050877

§ 371 (c)(1),
(2) Date: Jun. 27, 2023

(87) PCT Pub. No.: WO2022/152900

PCT Pub. Date: Jul. 21, 2022

(65) Prior Publication Data

US 2024/0124787 A1 Apr. 18, 2024

(30) Foreign Application Priority Data

Jan. 18, 2021 (EP) ..... 21152117

(51) Int. Cl.
*C10G 49/04* (2006.01)
*C10G 3/00* (2006.01)

(52) U.S. Cl.
CPC ..... *C10G 49/04* (2013.01); *C10G 3/50* (2013.01); *C10G 2300/1003* (2013.01); *C10G 2300/1014* (2013.01)

(58) Field of Classification Search
CPC ..... C10G 49/04
See application file for complete search history.

(56) References Cited

U.S. PATENT DOCUMENTS

| | | | | |
|---|---|---|---|---|
| 2,984,617 | A | 5/1961 | De et al. | |
| 3,691,066 | A | 9/1972 | Carruthers et al. | |
| 4,202,798 | A * | 5/1980 | Johnson | B01J 23/85 208/216 PP |
| 4,409,092 | A | 10/1983 | Johnson et al. | |
| 5,009,770 | A | 4/1991 | Miller et al. | |
| 5,904,838 | A | 5/1999 | Kalnes et al. | |
| 8,324,438 | B2 | 12/2012 | Brandvold et al. | |
| 8,492,600 | B2 | 7/2013 | Marker et al. | |
| 8,853,475 | B2 | 10/2014 | Kalnes | |
| 2009/0253948 | A1 * | 10/2009 | McCall | C10G 3/47 585/240 |
| 2011/0138680 | A1 | 6/2011 | Dandeu et al. | |
| 2014/0275666 | A1 | 9/2014 | Bauer et al. | |
| 2015/0057475 | A1 | 2/2015 | Wang et al. | |
| 2016/0168482 | A1 | 6/2016 | Mezza et al. | |
| 2019/0338194 | A1 * | 11/2019 | Brodeur-Campbell | C10B 53/07 |
| 2024/0400904 | A1 | 12/2024 | Stummann et al. | |

FOREIGN PATENT DOCUMENTS

| | | | |
|---|---|---|---|
| EP | 535505 | A1 | 4/1993 |
| EP | 2707460 | A1 | 3/2014 |
| EP | 2814916 | B1 | 4/2019 |
| EP | 3164472 | B1 | 4/2019 |
| EP | 3347438 | B1 | 2/2020 |
| RU | 2725870 | C1 | 7/2020 |
| WO | WO 2010/028717 | A2 | 3/2010 |
| WO | 2012/153001 | A1 | 11/2012 |
| WO | WO 2015/101713 | A1 | 7/2015 |
| WO | WO 2019/228797 | A1 | 12/2019 |
| WO | WO 2020/148343 | A1 | 7/2020 |
| WO | 2020/160850 | A1 | 8/2020 |
| WO | 2021/105326 | A1 | 6/2021 |
| WO | 2021/110395 | A1 | 6/2021 |
| WO | WO 2021/180808 | A1 | 9/2021 |
| WO | 2021/204818 | A1 | 10/2021 |
| WO | 2021/209555 | A1 | 10/2021 |
| WO | WO 2022/008508 | A1 | 1/2022 |
| WO | 2022/023262 | A1 | 2/2022 |
| WO | 2022/023263 | A1 | 2/2022 |
| WO | 2022/063597 | A1 | 3/2022 |
| WO | 2022/144235 | A1 | 7/2022 |
| WO | 2022/152900 | A1 | 7/2022 |
| WO | WO 2022/152896 | A1 | 7/2022 |

OTHER PUBLICATIONS

Brown (Dec. 2020) "Heterodoxy in Fast Pyrolysis of Biomass," 35, 2, 987-1010. https://dx.doi.org/10.1021/acs.energyfuels.0c03512.
Dybkjaer (1995) "Tubular reforming and autothermal reforming of natural gas—an overview of available processes", Fuel Processing Technology 42, 85-107.
European Search Report dated Jul. 2, 2021 in corresponding European Application No. 21152117.4.
European Search Report dated Jun. 30, 2021 in corresponding European Application No. 21152112.5.
Gollakota et al. (2018) "A review of hydrothermal liquefaction of biomass", Renewable and Sustainable Energy Reviews, vol. 81, Part 1, p. 1378-1392.
International Search Report and Written Opinion, dated Apr. 25, 2022, corresponding to International Application No. PCT/EP2022/050863, 18 pp.

(Continued)

*Primary Examiner* — Randy Boyer
(74) *Attorney, Agent, or Firm* — Boone IP Law

(57) ABSTRACT

The invention relates to a process for hydrotreating a liquid oil stream such as pyrolysis oil stream by, in continuous operation, reacting the liquid oil stream with hydrogen in the presence of a nickel-molybdenum (Ni—Mo) based catalyst at a temperature of 20-240° C., a pressure of 100-200 barg and a liquid hourly space velocity (LHSV) of 0.1-1.1 $h^{-1}$, and a hydrogen to liquid oil ratio, defined as the volume ratio of hydrogen to the flow of the liquid oil stream, of 1000-6000 NL/L thereby forming a stabilized liquid oil stream.

1 Claim, No Drawings

(56) References Cited

OTHER PUBLICATIONS

International Search Report and Written Opinion, dated Apr. 8, 2022, corresponding to International Application No. PCT/EP2022/050877, 15 pp.
Ong et al. (2018) "Hydrothermal liquefaction of Radiata Pine with Kraft black liquor for integrated biofuel production," Journal of Cleaner Production, Elsevier, Amsterdam, NL, vol. 199, pp. 737-750, XP085444852, ISSN: 0959-6526, DOI: 10.1016/J.JCLEPRO.2018.07.218.
Panisko et al. (2015) "Characterization of the aqueous fractions from hydrotreatment and hydrothermal liquefaction of lignocellulosic feedstocks," Biomass and Bioenergy, Pergamon, Amsterdam, NL, vol. 74, pp. 162-171, XP029144799, ISSN: 0961-9534, DOI: 10.1016/J.BIOMBIOE.2015.01.011.
Rostrup-Nielsen et al. (2002) "Large-scale Hydrogen Production", Cattech 6, 150-159.
Shumeiko et al. (Sep. 2020) "Efficient one-stage bio-oil upgrading over sulfide catalysts", ACS Sus-tainable Chem. Eng. 8, 15149-15167.
Del Rio Juan I, et al "Pre-hydrogenation stage as a strategy to improve the continuous production of a diesel-like biofuel from palm oil", Renewable Energy, Pergamon Press, Oxford, GB, vol. 168, Dec. 23, 2020, pp. 505-515.
European Patent Office Extended European Search Report for Application No. 23155600 2 dated Jun. 13, 2023, 10 pages.
Extended European Search Report for Application No. 22215996.4 dated Jun. 5, 2023, 9 pages.
Extended European Search Report issued by the European Patent Office for Application No. 22216003.8 dated Jun. 12, 2023, 9 pages.
International Preliminary Report on Patentability received for PCT Patent Application No. PCT/EP2022/050877, mailed on Jul. 27, 2023, 8 pages.
International Preliminary Report on Patentability received for PCT Patent Application No. PCT/EP2023/087208, mailed on Jul. 3, 2025, 8 pages.
International Preliminary Report on Patentability received for PCT Patent Application No. PCT/EP2023/087392, mailed on Jul. 3, 2025, 7 pages.
International Search Report for Application No. PCT/EP2023/086802 dated Feb. 29, 2024, 4 pages.
Office Action received for Chinese Patent Application No. 202280009765.4, mailed on May 1, 2025, 13 pages (7 pages of English Translation and 6 pages of Original Document).
PCT International Search Report for Application No. PCT/EP2023/087208 dated Feb. 29, 2024, 5 pages.
PCT International Search Report for Application No. PCT/EP2023/087392 dated Mar. 12, 2024, 4 pages.
PCT Written Opinion of the International Searching Authority for Application No. PCT/EP2023/086802 dated Feb. 29, 2024, 6 pages.
PCT Written Opinion of the International Searching Authority for Application No. PCT/EP2023/087208 dated Feb. 29, 2024, 6 pages.
PCT Written Opinion of the International Searching Authority for Application No. PCT/EP2023/087392 dated Mar. 12, 2024, 5 pages.
Xu Y, et al "Upgrading of the liquid fuel from fast pyrolysis of biomass over MoNi/@c-Al"20"3 catalysts" Applied Energy, Elsevier Science Publishers, GB, vol. 87, No. 9, Sep. 1, 2010, pp. 2886-2891.

* cited by examiner

LOW TEMPERATURE STABILIZATION OF LIQUID OILS

CROSS-REFERENCE TO RELATED APPLICATIONS

This application is a U.S. National Stage Application filed under 35 U.S.C. § 371 of PCT/EP2022/050877 filed Jan. 17, 2022 (WO 2022/152900), which claims priority to and the benefit of European Patent Application Serial No. 21152117.4, filed Jan. 18, 2021, which are each hereby incorporated by reference in its entirety.

The invention relates to the field of hydroprocessing of liquid oils such as pyrolysis oils, more specifically to the stabilization of the liquid oil by hydrotreating prior to being upgraded by further hydroprocessing, such as hydrodeoxygenation (HDO). More particularly, the invention relates to the stabilization of condensed pyrolysis oil derived from the pyrolysis of a solid renewable feedstock.

The field of renewable feedstocks has been attracting a great deal of attention, not only in Europe, but also US and China. Using renewable feedstocks enables a sustainable approach to the production of hydrocarbon products boiling in the transportation fuel range, in particular any of diesel, jet fuel and naphtha.

The hydroprocessing of renewable feedstocks is a challenging task, due to the variety and complexity of these feedstocks. Currently, it is normally perceived that there are three generations of renewable feedstocks. The first generation are renewable feedstocks which are already liquid and include virgin oils, such as rapeseed oil and soybean oil. The second generation are waste oil and fats, such as used cooking oils, animal fats and crude tall oil (CTO). The third generation is much larger in volume, i.e. is more available, than for instance the second generation. This third generation includes solid renewable feedstocks which encompasses: i) solid waste, such as agricultural residue and forestry residue, for instance lignocellulosic biomass such as grass; and ii) low indirect land-use change (I LUC) crops such as castor, which offer the benefit of not competing for space with food crops and can be grown in difficult climate.

Due to the Renewable Energy Directive II (RED II) under the European Union, a higher demand is expected for the hydroprocessing of advanced renewable feedstocks, such as pyrolysis oils derived from solid renewable feedstocks. The pyrolysis oil may have a very high oxygen content, which needs to be decreased before it can be used as liquid fuel, i.e. as hydrocarbon fuel boiling in the transportation fuel range. The oxygen is generally removed by hydroprocessing in a catalytic hydrodeoxygenation (HDO) using high pressure (100-200 bar) and high temperature (350-400° C.). However, a liquid oil such as pyrolysis oil or a hydrothermal liquefaction oil (hereinafter also referred to as HTL oil) is very unstable and when heated it tends to polymerize, which leads to rapid catalyst deactivation and plugging of the HDO reactor, due to coking.

Stabilization pyrolysis oils by converting i.a. carbonyls into alcohols, is required. It is known to stabilize pyrolysis oils by the use of NiCu and $Ru/TiO_2$ catalysts. However, these catalysts are sulfur sensitive. Pyrolysis oils tend to contain at least some minor concentrations of sulfur, thereby deactivating the catalyst over time due to sulfur poisoning. Accordingly, a sulfur guard bed is required to overcome this problem.

EP 2707460 A1 discloses a process for stabilizing pyrolysis oil which includes hydrogenating a pyrolysis oil in the presence of a ruthenium metal catalyst at a temperature of at least about 70 C and at a pressure of at least about 600 psig (about 40 barg) to form a hydrogenated a pyrolysis oil exhibiting an increase in viscosity of less than 10 percent.

French et al. "Evaluate impact of catalyst type on oil yield and hydrogen consumption from mild hydrotreating", Energy Fuels 2014, 28 (5) 3086-3095, discloses the use of various Pd, Ru and sulfided NiMo catalyst normally used for hydrotreating, for the hydrotreatment of bio-oil (pyrolysis oil) in batch or semibatch conditions at temperatures of 150-400° C. and pressure of 40-160 bar. A mixture of bio-oil and catalyst is first heated to 150° C. with a hold time of 1 h, and then the mixture is heated to 340-400° C.

Shumeiko et al. "Efficient one-stage bio-oil upgrading over sulfide catalysts", ACS Sustainable Chem. Eng. 2020, 8, 15149-15167, discloses the upgrading of a pyrolysis oil using different sulfided NiMo catalysts by operating at a temperature of 340° C., hydrogen pressure of 40 bar, hydrogen to oil ratio of 1800 NL/L, and space velocity (LHSV) of 0.5 $h^{-1}$. A significant deactivation of the catalysts was observed.

Polymerization and etherification may also take place during the stabilization, which increases the viscosity of the resulting product. This is a serious challenge leading to the plugging of pipes between the hydrotreatment unit used for stabilization and the subsequent hydroprocessing reactor, for instance a HDO unit.

US 20014/0275666 A1 discloses a process for treating bio-oil or pyrolysis oil in a two-stage process. In a first hydrotreatment stage (stabilization), organic reactive molecules are reduced without substantial deoxygenation. In the second stage, the resulting stream is introduced into a second hydrotreatment stage for hydrodeoxygenation, HDO). The problem of plugging is addressed by providing a fractionation unit (distillation, D1—FIG. 4) upstream the fixed-bed "stabilization" (1st stage), Further, experiments A-C, Table II therein, show the treatment of a feed only having a minor oxygen content (13.8 wt % oxygen) with a NiMo catalyst in a fixed bed reactor, with a high space velocity (>1 $h^{-1}$) and relatively low hydrogen consumption of 8000 std. cu ft/barrel or lower (corresponding to a $H_2$ to liquid oil ratio of 1348 NL/L or lower). The longest running time was obtained for Experiment C having the lowest pressure, temperature and $H_2$ to liquid oil ratio.

Now surprisingly, it has been found that a Ni—Mo based catalyst is capable of effectively stabilizing liquid oils such as pyrolysis oils or HTL oils at low temperatures, i.e. in the range 20-240° C., while at the same time being sulfur tolerant. Furthermore, the reactions leading to stabilization are not inhibited, or least only to a low extent, by the presence of organic nitrogen. For instance, the stabilization is not inhibited by pyridine present in the liquid oil. In fact, pyridine inhibits hydrodeoxygenation in the stabilization reactor, which is advantageous since this leads to a lower exotherm in the reactor, thus making it easier to control the temperature.

By the present invention, the liquid oil, e.g. pyrolysis oil is stabilized at low temperatures by the conversion of at least the most reactive compounds in the pyrolysis oil, such as furfural, furans, aldehydes, ketones and acids, into alcohols, for instance by efficiently converting carbonyls into alcohols. The alcohols can further be converted to saturated organic compounds during the stabilization, and/or in a subsequent hydroprocessing stage such as HDO.

Accordingly, in a first aspect, the invention provides a process for hydrotreating a liquid oil stream by, in a continuous operation in a fixed bed reactor, reacting the liquid oil stream with hydrogen in the presence of a nickel-molybdenum (Ni—Mo) based catalyst at a temperature, e.g. inlet temperature, of 20-240° C., a pressure of 100-200 barg, a liquid hourly space velocity (LHSV) of 0.1-1.1 $h^{-1}$, and a hydrogen to liquid oil ratio, defined as the volume ratio of hydrogen to the flow of the liquid oil stream, of 1000-6000 NL/L, such as 2000-5000 NL/L, thereby forming a stabilized liquid oil stream.

The combination of features i.e. low temperatures, high pressure, low LHSV and high $H_2$-to liquid oil ratio, as recited above, enables stabilization of the liquid oil by i.a. converting carbonyls to alcohols and thereby increase operation time before plugging issues—if any—arise, while at the same time suppressing coking of the catalyst and attendant catalyst deactivation, as well as avoiding hydrogen starvation.

It would be understood that the unit "barg" denotes pressure above atmospheric (atmospheric pressure: about 1 bar). The pressure is also referred as "hydrogen pressure".

The temperature range 20-240° C. encompasses the inlet temperature of the liquid oil stream and the outlet temperature of stabilized liquid oil stream. For instance, the inlet temperature can be 20, 40, 60 or 80° C. The process is exothermic thus a raise in temperature of about 100° C. or more occurs. The higher the inlet temperature e.g. 80° C., the easier the ignition of the process to initiate the exotherm. The outlet temperature can for instance be 150 or 200 or 240° C. More generally, the temperature in a given step or reactor (unit) thereof, means the inlet temperature in an adiabatic step, or the reaction temperature in an isothermal step. Accordingly, suitably said temperature of 20-240° C. means inlet temperature.

The term continuous operation, as is well known in the art, means that the incoming stream of liquid oil during a given production cycle is constant, as also is the stabilized liquid oil stream being withdrawn as the outcoming product. This contrasts a batch operation i.e. discontinuous operation, as is also well known in the art, in which the total amount of liquid oil and catalyst is introduced at the beginning of the process, and the outcoming product is withdrawn after a certain period of time.

By the present invention, a continuous operation process is used, since contrary to a batch operation, there is no dependency on the outcoming product (stabilized liquid oil) being fluid at all times. In a batch operation, such as in the above cited French et al., the liquid oil could start fluid, then solidify for a period during a first temperature of 150° C. and then become fluid again when heated to the final temperatures of 340-400° C. Furthermore, a batch operation gives only an idea about the initial catalyst activity, thus it can easily overestimate the catalyst activity, which is also crucial for industrial application.

Moreover, there is a large difference between operating with an outlet temperature of 340° C. as in the prior art, and 240° C. or lower, for instance 200° C., as in the present invention. At ~200° C. carbonyls are converted to alcohols as it will also become apparent from discussion below. Some sugars may also be converted to diols and dehydrate some of the alcohols. On the other hand, at 340° C. phenols will start to be removed and depending on the pressure and LHSV, the oxygen in the liquid oil may also be removed.

By the invention, the process is also conducted at a hydrogen to liquid oil ratio of 1000-6000 NL/L, such as 2000-5000 NL/L, for instance 2500, 3000, 3500, 4000 or 4500 NL/L. As used herein, the term "hydrogen to liquid oil ratio" or "$H_2$/oil ratio" means the volume ratio of hydrogen to the flow of the liquid oil stream.

It would be understood, that the unit NL means "normal" liter, i.e. the amount of gas taken up this volume at 0° C. and 1 atmosphere.

By the present invention, the performance is also superior than e.g. Shumeiko et al. It has now been found that the above combination of features, in particular the combination of lower temperature and higher pressure (i.e. hydrogen pressure) optionally together with the higher $H_2$/oil ratio in accordance with the present invention e.g. 2000-5000 NL/L, enables suppressing coking of the catalyst and attendant catalyst deactivation, as well as avoiding hydrogen starvation.

In order to stabilize pyrolysis oil, the hydrogen consumption usually, as measured by the $H_2$/oil ratio, is between 100-350 NL/L, yet in order to avoid hydrogen starvation we have found that the $H_2$/oil ratio should be higher, i.e. 1000-6000 NL/L, for instance between 1000-2000 or 2000-5000 NL/L. Since the stabilized pyrolysis oil is suitably sent directly to a HDO reactor, as it will become apparent from a below embodiment, and the hydrogen consumption generally would be between 400-800 NL/L, we have found that it is even more preferable that the $H_2$/oil ratio is between 2000-5000 NL/L in order to avoid hydrogen starvation. For instance, 100-350 NL/L is needed to stabilize the oil and 400-800 NL/L to deoxygenate it, thus the total hydrogen consumption for this particular instance can be as high as 1150 NL/L. Adding $H_2$ in excess of this amount, e.g. 2000-5000 NL/L pushes the reaction rate and/or equilibrium.

Hence, by the present invention, low temperature (20-240° C., such as 80-240° C. or 100-240° C.) stabilization of a liquid oil is possible. Furthermore, by the present invention, not only stabilization of the liquid oil is possible thereby avoiding the plugging problems described above, but also stabilization without deactivating the catalyst and without risk of hydrogen starvation.

In an embodiment, wherein the liquid oil stream contains at least 20 wt % oxygen (O), such as at least 30 wt % 0, or at least 45 wt % 0.

The oxygen is suitably determined by standard elemental analysis. This oxygen content is representative of particularly reactive liquid oil feeds, such as pyrolysis oils or HTL oils, as the content of oxygen may serve as a proxy of how reactive the liquid oil is. Thus, a highly reactive liquid oil stream may contain as much as 45 wt % oxygen or even higher.

In an embodiment, the ratio of the carbonyl number as measured by ASTM E 3146 in mol/kg of the liquid oil stream with respect to the stabilized liquid oil stream, i.e. carbonyl number ratio, is 1.7 or higher.

It has been found that a ratio of 1.7 or higher, such as 1.9, the plugging of a subsequent HDO reactor is avoided.

In an embodiment, the carbonyl number of the stabilized liquid oil stream is below 3.0 mol/kg, as measured by ASTM E 3146.

Thereby the process may be operated by controlling the carbonyl number in the stabilization reactor, so it is maintained below 3.0 mol/kg, since it has been found that increasing the carbonyl number to 3.0 or higher may cause coking and thus plugging of a downstream HDO unit (reactor). Suitably also, the carbonyl number ratio is monitored so that it is 1.7 or higher at any time, to avoid coking and thus plugging of a downstream HDO reactor.

In an embodiment, the liquid oil stream is a pyrolysis oil stream or a hydrothermal liquefaction oil (HTL oil) stream.

In an embodiment the liquid oil stream is a pyrolysis oil stream which comprises at least 0.5 mol/kg of one or more of: aldehyde compounds, ketones, alcohols, furfural, as determined by ASTM E3146-20.

Ni—Mo based catalysts are well known for hydrotreating purposes at operating temperatures well above 200° C., such as 250° C. or higher, and pressures in the range of e.g. 30-150 bar. For instance, Ni—Mo catalysts are suitably used as a first-stage catalyst in hydrocracking units, where removal of nitrogen and density improvement of straight-run and cracked fractions in the VGO range is important. Ni—Mo catalysts are also suitable for producing ultra-low sulfur diesel (ULSD) in hydrotreating units processing a broad range of straight-run and cracked distillate stocks. Ni—Mo-catalysts are also suitable for saturation of aromatics in high-pressure units, and which is important when for instance cetane improvement and low aromatic content is desired.

In an embodiment, the temperature, e.g. inlet temperature, is in the range 100-225° C., e.g. 150-200° C.; the pressure is 125-175 barg e.g. 150 barg; and LHSV is 0.8-1.0 $h^{-1}$ e.g. 0.9 $h^{-1}$. At these particular conditions, compounds such as cyclopentanone or furfural present in e.g. pyrolysis oil are substantially converted to the respective alcohols. For instance, at 150-200° C., about 150 barg, and LHSV of about 0.9 $h^{-1}$, optionally where the hydrogen to liquid oil ratio is 1000-1300 NL/L e.g. 1100-1200 NL/L, the conversion of furfural, an organic compound normally derived from the renewable source lignocellulosic biomass, is up to 100%

In an embodiment, the Ni—Mo based catalyst is a supported catalyst having a Ni content of 3-5 wt %, Mo content of 15-25 wt % and optionally also a P content of 1-3 wt %, based on the total weight of the catalyst.

A catalyst with this composition is particularly suitable for the stabilization of the liquid oil, in particular highly reactive liquid oils containing at least 20 wt % oxygen, for instance at least 45 wt % oxygen.

In a particular embodiment, the support is selected from alumina, silica, titania and combinations thereof, i.e. a refractory support. In another particular embodiment, the support is a molecular sieve having topology MFI, BEA or FAU. As used herein, the term "topology MFI, BEA or FAU", means a structure as assigned and maintained by the International Zeolite Association Structure Commission in the Atlas of Zeolite Framework Types, which is at http://www.iza-structure.org/databases/ or for instance also as defined in "Atlas of Zeolite Framework Types", by Ch. Baerlocher, L. B. McCusker and D. H. Olson, Sixth Revised Edition 2007.

In an embodiment, the Ni—Mo based catalyst is in sulfided form, i.e. NiMoS. The catalyst may be pre-sulfided by exposure of to a sulfur containing stream or it may be sulfided in-situ i.e. during operation, for instance by sulfur present in the pyrolysis oil.

By the present invention it has been found that an alcohol in the pyrolysis oil is first dehydrated to the respective unsaturated organic compound e.g. alkene and then hydrogenated to the respective saturated organic compound, e.g. alkane. For instance, 1-octanol present in the pyrolysis oil is first dehydrated to octene and then hydrogenated to octane. On the other hand, a ketone such as cyclopentanone (a cyclic ketone) is first hydrogenated to the respective alcohol, namely cyclopentanol and then dehydrated to cyclopentene, prior to being hydrogenated to cyclopentane. The dehydration is inhibited by pyridine ($C_5H_5N$, i.e. a compound having an organic nitrogen) present in the pyrolysis oil, thus indicating that pyridine is adsorbed on the acid sites. However, the hydrogenation is not inhibited by pyridine, thus showing that the catalyst according to the conditions of the present invention is able to convert aldehydes and ketones or other compounds having carbonyl groups in the pyrolysis oil, which normally contains organic sulfur and nitrogen, to alcohols. In other words, the desired reaction in which compounds having carbonyl groups such as aldehydes and ketones, are converted by hydrogenation to their corresponding alcohols is enabled. The alcohols may be dehydrated to the corresponding alkanes, either as part of the reactions taking place in the stabilization, or in a subsequent hydrodeoxygenation.

Hence, by the present invention there is no need of removing organic nitrogen in the liquid oil prior to the stabilization reactor. The use of expensive units upstream for this purpose such as hydrodenitrogenation (HDN) is avoided. The nitrogen is removed in a subsequent HDO step.

Moreover, whereas prior art catalyst systems for stabilizing pyrolysis oil, such as NiCu-based catalysts or Ru-based catalysts, are prone to deactivation due to poisoning by sulfur present in the pyrolysis oil thus requiring the need of a sulfur guard bed or a previous hydrodesulfurization (HDS) step, in the present invention such presence of sulfur does not deactivate the catalyst and the sulfur can be even actively used to provide the catalyst in sulfided form, i.e. NiMo.

In an embodiment, the process further comprises a prior step of thermal decomposition of a solid renewable feedstock, for producing said liquid oil stream.

As used herein, the term "thermal decomposition" shall for convenience be used broadly for any decomposition process, in which a material is partially decomposed at elevated temperature (typically 250° C. to 800° C. or even 1000° C.), in the presence of substoichiometric amount of oxygen (including no oxygen). The product will typically be a combined liquid and gaseous stream, as well as an amount of solid char. The term shall be construed to include processes known as pyrolysis and hydrothermal liquefaction, both in the presence and absence of a catalyst.

Accordingly, in a particular embodiment, the thermal decomposition is pyrolysis, such as fast pyrolysis, as defined farther below, thereby producing said pyrolysis oil stream.

It would be understood that the thermal decomposition is conducted in a thermal decomposition section, Hence, the pyrolysis is conducted in a pyrolysis section, and the hydrothermal liquefaction is conducted in a hydrothermal liquefaction section.

As used herein, the term "section" means a physical section comprising a unit or combination of units for conducting one or more steps and/or sub-steps.

For the purposes of the present invention, the pyrolysis section generates two main streams, namely a pyrolysis off-gas stream and a pyrolysis oil stream. The pyrolysis section may be in the form of a fluidized bed, transported bed, or circulating fluid bed, as is well known in the art. For instance, the pyrolysis section may comprise a pyrolyser unit (pyrolysis reactor), cyclone(s) to remove particulate solids such as char, and a cooling unit for thereby producing said pyrolysis off-gas stream and said pyrolysis oil stream, i.e. condensed pyrolysis oil. The pyrolysis off-gas stream comprises light hydrocarbons e.g. C1-C4 hydrocarbons, CO and $CO_2$. The pyrolysis oil stream is also referred as bio-oil and is a liquid substance rich in blends of molecules usually consisting of more than two hundred different compounds including aldehydes, ketones and/or other compounds such as furfural having a carbonyl group, resulting from the depolymerisation of products treated in pyrolysis.

For the purposes of the present invention, the pyrolysis is preferably fast pyrolysis, also referred in the art as flash pyrolysis. Fast pyrolysis means the thermal decomposition of a solid renewable feedstock in the absence of oxygen, at temperatures in the range 350-650° C. e.g. about 500° C. and reaction times of 10 seconds or less, such as 5 seconds or less, e.g. about 2 sec. Fast pyrolysis may for instance be conducted by autothermal operation e.g. in a fluidized bed reactor. The latter is also referred as autothermal pyrolysis and is characterized by employing air, optionally with an inert gas or recycle gas, as the fluidizing gas, or by using a mixture of air and inert gas or recycle gas. Thereby, the partial oxidation of pyrolysis compounds being produced in the pyrolysis reactor (autothermal reactor) provides the energy for pyrolysis while at the same time improving heat transfer. For details about autothermal pyrolysis, reference is given to e.g "Heterodoxy in Fast Pyrolysis of Biomass" by Robert Brown: https://dx.doi.org/10.1021/acs.energyfuels.0c03512

It would therefore be understood, that for the purposes of the present invention, the use of autothermal pyrolysis. i.e. autothermal operation, is a particular embodiment for conducting fast pyrolysis.

There are several types of fast pyrolysis where a catalyst is used. Sometimes an acid catalyst is used in the pyrolysis reactor to upgrade the pyrolysis vapors, this technology is called catalytic fast pyrolysis and can both be operated in an in-situ mode (the catalyst is located in the pyrolysis reactor) and an ex-situ mode (the catalyst is placed in a separate reactor). The use of a catalyst conveys the advantage of lowering the activation energy for reactions thereby significantly reducing the required temperature for conducting the pyrolysis. In addition, increased selectivity towards desired pyrolysis oil compounds may be achieved.

In some cases, hydrogen is added to the catalytic pyrolysis which is called reactive catalytic fast pyrolysis. If the catalytic pyrolysis is conducted at a high hydrogen pressure (~>5 barg) it is often called catalytic hydropyrolysis.

In an embodiment, the pyrolysis stage is fast pyrolysis which is conducted without the presence of a catalyst and hydrogen, i.e. the fast pyrolysis stage is not catalytic fast pyrolysis, hydropyrolysis or catalytic hydropyrolysis. This enables a much simpler and inexpensive process.

In an embodiment, said pyrolysis off-gas stream comprises CO, $CO_2$ and light hydrocarbons such as C1-C4, and optionally also $H_2S$.

In an embodiment, the thermal decomposition is hydrothermal liquefaction. Hydrothermal liquefaction means the thermochemical conversion of biomass into liquid fuels by processing in a hot, pressurized water environment for sufficient time to break down the solid bio-polymeric structure to mainly liquid components. Typical hydrothermal processing conditions are temperatures in the range of 250-375° C. and operating pressures in the range of 40-220 bar. This technology offers the advantage of operation of a lower temperature, higher energy efficiency and lower tar yield compared to pyrolysis, e.g. fast pyrolysis. For details on hydrothermal liquefaction of biomass, reference is given to e.g. Golakota et al., "A review of hydrothermal liquefaction of biomass", Renewable and Sustainable Energy Reviews, vol. 81, Part 1, January 2018, p. 1378-1392.

In an embodiment, the thermal decomposition further comprises passing said solid renewable feedstock through a solid renewable feedstock preparation section comprising for instance drying for removing water and/or comminution for reduction of particle size. Any water/moisture in the solid renewable feedstock which vaporizes in for instance the pyrolysis section condenses in the pyrolysis oil stream and is thereby carried out in the process, which may be undesirable. Furthermore, the heat used for the vaporization of water withdraws heat which otherwise is necessary for the pyrolysis. By removing water and also providing a smaller particle size in the solid renewable feedstock the thermal efficiency of the pyrolysis section is increased.

In an embodiment, the solid renewable feedstock is a lignocellulosic biomass including: wood products, forestry waste, and agricultural residue. In another embodiment the solid renewable feedstock is municipal waste, in particular the organic portion thereof. For the purposes of the present application, the term "municipal waste" is interchangeable with the term "municipal solid waste" and means a feedstock containing materials of items discarded by the public, such as mixed municipal waste given the waste code 200301 in the European Waste Catalog.

In a particular embodiment, the lignocellulosic biomass is forestry waste and/or agricultural residue and comprises biomass originating from plants including grass such as nature grass (grass originating from natural landscape), wheat e.g. wheat straw, oats, rye, reed grass, bamboo, sugar cane or sugar cane derivatives such as bagasse, maize and other cereals.

Any combinations of the above is also envisaged.

As used herein, the term "lignocellulosic biomass" means a biomass containing, cellulose, hemicellulose and optionally also lignin. The lignin or a significant portion thereof may have been removed, for instance by a prior bleaching step.

In an embodiment, the process further comprises passing the stabilized pyrolysis oil stream through a hydrodeoxygenation (HDO) step. Thereby, any organic nitrogen present in the stabilized pyrolysis oil stream is removed and a hydrotreated stream is produced, which can be further treated for producing hydrocarbon products boiling in the transportation fuel range, such as diesel, jet fuel and naphtha. The further treatment may include any of: hydrodewaxing, hydrocracking, or isomerization, as is well known in the art of fossil oil refining.

As mentioned before, renewable feedstocks including intermediate products thereof such as liquid oils e.g. pyrolysis oil, often contain a high amount of oxygen compounds and unsaturated hydrocarbon. During the hydrotreating of renewable feedstock or liquid oil, the oxygen is mainly removed as $H_2O$, which gives a paraffinic fuel consisting of paraffins with the same number for carbon atoms as in the backbone of the triglycerides. This is called the hydrodeoxygenation (HDO) pathway. Oxygen can also be removed by dicarboxylic (DCO) pathway, which generates $CO_2$ instead of $H_2O$:

$$C_{17}H_{34}COOH+3.5H_2 \leftrightarrow C_{18}H_{38}+2H_2O \quad \text{HDO pathway:}$$

$$C_{17}H_{34}COOH+0.5H_2 \leftrightarrow C_{17}H_{36}+CO_2 \quad \text{Decarboxylation pathway:}$$

When stabilizing the liquid oil, alcohols and among other acids e.g. fatty acids therein, are converted: alcohols may be converted to their respective alkanes or unsaturated organic compounds and thereafter hydrogenated to the respective alkanes; acids and other compounds comprising a carbonyl group such as aldehydes and ketones are first converted by hydrogenation to their respective alcohols and these may later be converted to alkanes as explained above. In the stabilization, the oxygen atom in the carbonyl group of a given organic compound may be removed as $H_2O$ or CO, per the above recited HDO and DCO reaction pathways. As an example, for phenol the oxygen is removed directly thus producing benzene and $H_2O$. The oxygen in phenol can also be removed via a hydrogenation pathway, where phenol is first converted to cyclohexanol and then to cyclohexane and $H_2O$.

Remaining alcohols and acids or other compounds having carbonyl groups from the stabilization would then be converted to paraffins in the subsequent HDO stage, per the recited reaction HDO and DCO pathways.

The material catalytically active in hydrotreating, e.g. HDO, typically comprises an active metal (sulfided base metals such as nickel, cobalt, tungsten and/or molybdenum, but possibly also either elemental noble metals such as platinum and/or palladium) and a refractory support (such as alumina, silica or titania, or combinations thereof).

Hydrotreating e.g. HDO conditions involve a temperature in the interval 250-400° C., a pressure in the interval 30-150 bar, and a liquid hourly space velocity (LHSV) in the interval 0.1-2, optionally together with intermediate cooling by quenching with cold hydrogen, feed or product.

The material catalytically active in hydrodewaxing typically comprises an active metal (either elemental noble metals such as platinum and/or palladium or sulfided base metals such as nickel, cobalt, tungsten and/or molybdenum), an acidic support (typically a molecular sieve showing high shape selectivity, and having a topology such as MOR, FER, MRE, MVWV, AEL, TON and MTT) and a refractory support (such as alumina, silica or titania, or combinations thereof).

Isomerization conditions involve a temperature in the interval 250-400° C., a pressure in the interval 20-100 bar, and a liquid hourly space velocity (LHSV) in the interval 0.5-8.

The material catalytically active in hydrocracking is of similar nature to the material catalytically active in isomerization, and it typically comprises an active metal (either elemental noble metals such as platinum and/or palladium or sulfided base metals such as nickel, cobalt, tungsten and/or molybdenum), an acidic support (typically a molecular sieve showing high cracking activity, and having a topology such as MFI, BEA and FAU) and a refractory support (such as alumina, silica or titania, or combinations thereof). The difference to material catalytically active isomerization is typically the nature of the acidic support, which may be of a different structure (even amorphous silica-alumina) or have a different acidity e.g. due to silica:alumina ratio.

Hydrocracking conditions involve a temperature in the interval 250-400° C., a pressure in the interval 30-150 bar, and a liquid hourly space velocity (LHSV) in the interval 0.5-8, optionally together with intermediate cooling by quenching with cold hydrogen, feed or product Other types of hydrotreating are also envisaged, for instance hydrodearomatization (HDA). The material catalytically active in hydrodearomatization typically comprises an active metal (typically elemental noble metals such as platinum and/or palladium but possibly also sulfided base metals such as nickel, cobalt, tungsten and/or molybdenum) and a refractory support (such as amorphous silica-alumina, alumina, silica or titania, or combinations thereof).

Hydrodearomatization conditions involve a temperature in the interval 200-350° C., a pressure in the interval 20-100 bar, and a liquid hourly space velocity (LHSV) in the interval 0.5-8.

In an embodiment, the process further comprises passing the stabilized liquid oil stream through one or more metal guards active in hydrometallation (HDM) and/or hydrodeoxygenation (HDO), prior to said HDO step.

Thereby, a purified hydrotreated effluent stream is produced prior to feeding it to the subsequent HDO step. The term "metal guard bed active in HDM and/or HDO" is also referred herein simply as "metal guard bed", and means a bed, i.e. a fixed bed, which comprises a material active in HDM and/or HDO, such as catalyst active in HDM and/or HDO, so that apart from for removing e.g. phosphorous (P), iron (Fe), nickel (Ni), or vanadium (V), silicon (Si), halides, or combinations thereof, the material may also be provided with deoxygenation activity. A suitably guard bed for at least removing P and Fe is a porous material comprising alumina, the alumina comprising alpha-alumina, with the porous material comprising one or more metals selected from Co, Mo, Ni, W and combinations thereof, and said porous material having a BET-surface area of 1-110 m 2/g, suitably also having a total pore volume of 0.50-0.80 ml/g, as measured by mercury intrusion porosimetry, and a pore size distribution (PSD) with at least 30 vol % of the total pore volume being in pores with a radius ≥400 Å, suitably pores with a radius ≥500 Å, such as pores with a radius up to 5000 Å; as for instance disclosed in Applicant's co-pending patent application PCT/EP2021/068656. Another suitably guard bed is a catalyst comprising molybdenum supported on alumina, i.e. a $Mo/Al_2O_3$ catalyst. Yet another suitably catalyst is a catalyst having demetallization activity and moderate hydrodesulfurization activity, such as a commercial TK-743 catalyst.

Hydrodemetallation (HDM), as is well known in the art, means a pretreatment, by which free metals are generated and then reacted with e.g. $H_2S$ into metal sulfides. It would be understood, that this is different from e.g. hydrodesulfurization (HDS) in which the heteroatom (S) is removed in gas form.

Advantages of the invention include:

- A process for stabilizing pyrolysis oil which is tolerant to any sulfur such as organic sulfur present in the pyrolysis oil, or by the presence of organic nitrogen. The use of for instance a sulfur guard bed and/or upstream units for removing sulfur and nitrogen (HDS, HDN) or a stripping unit, is thereby eliminated.
- A process for stabilizing pyrolysis oil with reduced increase in viscosity thereby avoiding plugging, e.g. plugging of downstream pipes or other equipment.
- A process where the stabilized pyrolysis oil does not plug downstream pipes or other equipment, while at the same time the catalyst activity is maintained and with no risk of hydrogen starvation.
- A simpler process for the conversion of third generation renewable feedstocks into hydrocarbon products boiling in the transportation fuel range, in particular any of diesel, jet fuel and naphtha.

EXAMPLES

Example 1 which is according to the present invention, involves reaction of a pyrolysis model feed consisting of 81.8 mol % 1-propanol, 7.32 mol % furfural, 10.8 mol % 1-octanol, and 0.055 mol % dimethyl disulfide, reacted in the presence of a commercially available catalyst comprising of 3.5 wt % Ni, 19.4 wt % Mo, 2.0 wt % P. The catalyst was sulfided prior to the experiment. The test conditions and conversions are shown in Table 1, the total experimental time with the model feed was 121 hours, during which no sign of plugging was observed. The conversion of furfural was 35% at 100° C., but was 100% at 150, 175, and 200° C. The conversion of 2-propanol was 11% at 100° C. and increased with increasing temperature and was 93% at 200° C. The conversion of 1-octanol was 0% at 100° C., but increased with increasing temperature and was 84% at 200° C. This clearly shows that the NiMo based catalyst is active for stabilization in the temperature range for this pyrolysis model feed at 150 to 200° C.

Based on the results from gas chromatography-mass spectrometry of the liquid product (GC-MS) it was assumed that the reaction pathway shown below was the main reaction pathway for furfural:

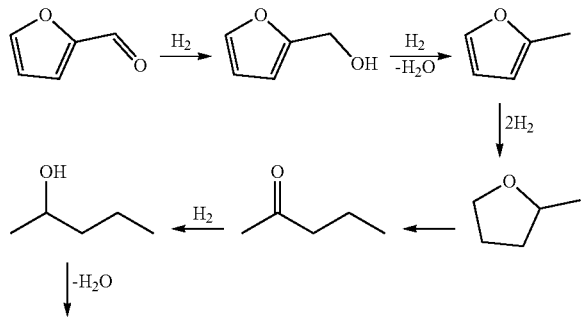

-continued

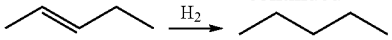

Surprisingly, furan-2-yl-methanol was not detected with GC-MS, thus it can be assumed that the hydrodeoxygenation of furan-2-yl-methanol to 2-methyl-furan was fast. In the literature, e.g. ACS Sustain. Chem. Eng. 2016, 4 (10), 5533-5545, it is often found that furan-2-yl-methanol is hydrogenated to tetrahydric-furan-2-yl-methanol before the alcohol is removed. While tetrahydric-furan-2-yl-methanol was not detected with GC-MS, petane-1,4-diol was detected, thus indicating that it is plausible that tetrahydric-furan-2-yl was formed:

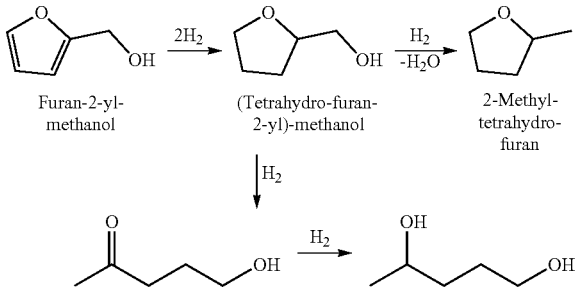

TABLE 1

Test conditions and conversion Example 1

| Temperature (° C.) | 100 | 150 | 175 | 200 |
|---|---|---|---|---|
| $H_2$/Oil (NL/L) | 1134 | 1124 | 1133 | 1130 |
| Pressure (barg) | 152 | 152 | 152 | 152 |
| LHSV ($h^{-1}$) | 0.88 | 0.89 | 0.88 | 0.88 |
| Conversion | | | | |
| 2-propanol (%) | 11 | 14 | 34 | 93 |
| Furfural (%) | 35 | 100 | 100 | 100 |
| 1-octanol (%) | 0 | 4 | 31 | 84 |

Example 2, which is comparative, involves reaction of a pyrolysis model feed consisting of 40.6 mol % furfural, 30.9 mol % toluene, 28.4 mol % n-heptane, and 0.2 mol % dimethyl disulfide, reacted in the presence of commercially active and typical hydrotreating catalyst, comprising of 1.7 wt % Ni and 6.1 wt % Mo. The catalyst was sulfided prior to the experiment. The test conditions and furfural conversion are shown in Table 2. The furfural conversion was 100% at run hour 23 but decreased to 42% at run hour 41. At the time the pressure drop over the reactor increased from 5 to 16 bar, thus showing that plugging occurred. Comparing Example 1 with Example 2 clearly shows the benefit of using the NiMo based catalyst according to the present invention which is combined with low temperature and high hydrogen pressure, compared to using a typical NiMo catalyst for hydrotreating at high temperature and moderate hydrogen pressure. In Example 1 according to the present invention, the run hour or total time on stream was 121 h with no sign of plugging.

TABLE 2

Test conditions and conversion Example 2

| Run hour (h) | 23 | 41 |
|---|---|---|
| Temperature (° C.) | 325 | 325 |
| $H_2$/oil (NL/L) | 644 | 644 |

TABLE 2-continued

Test conditions and conversion Example 2

| Run hour (h) | 23 | 41 |
|---|---|---|
| Outlet pressure (barg) | 72 | 71 |
| Pressure drop (bar) | 5 | 16 |
| WHSV ($h^{-1}$) | 17 | 17 |
| Furfural conversion (%) | 100 | 42 |

Example 3, which is according to the present invention, involves reaction of two pyrolysis model feeds having the molar composition shown in Table 3, reacted in the presence of commercially active material as in Example 1 comprising of 3.5 wt % Ni, 19.4 wt % Mo, 2.0 wt % P. The catalyst was sulfided prior to the experiment. The conversion and the product distribution in the produced organic liquid are shown in Table 4. The total experimental time with the model feeds was 218 hours and no sign of plugging was observed during the experiment. The conversion of cyclopentanone was 100% and was not affected by the addition of 500 wt ppm N in the form of pyridine to the mode feed. However, the addition of pyridine changed the yield of products from cyclopentanone. Without pyridine in the feed the main cyclopentanone product was cyclopentane (92.6%), but adding pyridine decreased yield of cyclopentanone and the yield of cyclopentanol increased to 47.5%. The conversion of 1-octanol was 93.6% before pyridine was added to the feed, but adding pyridine to the feed decreased the conversion to 4.6%. The main product from 1-octanol was octane (99.9%), but small amounts (0.1%) of C8 olefines were also observed. Adding pyridine to the feed also changed the 1-octanol product distribution, thus no C8 olefins were observed after pyridine was added, and small amounts of 1.1-oxybis octane (5.1%) and octyl octanoate (2.3%) was observed. It is assumed that 1.1-oxybis octane and octyl octanoate will be subsequently converted to octane under normal HDO conditions (temperature above 300° C.).

Since alcohols are less prone to form coke than carbonyls, an important reaction in the stabilization of pyrolysis oil is the conversion of carbonyls into alcohols. The observed inhibition of hydrodeoxygenation of alcohols by pyridine is therefore not considered to have a negative impact on the stabilization step and the alcohols can be removed in the following hydrodeoxygenation reactor. Furthermore, the inhibition of the hydrodeoxygenation leads to a lower exotherm in the stabilization reactor, thus making it easier to control the temperature.

TABLE 3

Composition of feeds used in Example 3

| | Feed 1 | Feed 2 |
|---|---|---|
| Cyclopentanone (mol %) | 7.53 | 7.52 |
| 1-octanol (mol %) | 92.37 | 92.16 |
| DMDS (mol %) | 0.10 | 0.10 |
| Pyridine (mol %) | 0.00 | 0.22 |
| N content (wt ppm) | 0 | 500 |

TABLE 4

| Conversion and yields (temperature: 190° C., pressure: 151 barg, $H_2$/oil ratio: 1160 NL/L, LHSV: 0.86 $h^{-1}$) | | |
|---|---|---|
| | Feed 1 | Feed 2 |
| Cyclopentanone conversion | 100 | 100 |
| 1-octanol conversion | 93.6 | 4.6 |
| Yield of cyclopentanone products | | |
| Cyclopentane (mol %) | 95.2 | 52.1 |
| Cyclopentanol (mol %) | 0.0 | 47.5 |
| Pentane (mol %) | 0.3 | 0.3 |
| C5 olefine (mol %) | 4.5 | 0.2 |
| Yeild of 1-octanol products | | |
| Octane (mol %) | 99.9 | 92.7 |
| C8 olefine (mol %) | 0.1 | 0.0 |
| 1.1-oxybis octane (mol %) | 0.0 | 5.1 |
| Octyl octanoate (mol %) | 0.0 | 2.3 |

This experiment shows that 1-octanol is first dehydrated to octene, which is then hydrogenated to octane. Cyclopentanone is first hydrogenated to cyclopentanol, then dehydrated to cyclopentene, and then hydrogenated to cyclopentane. The dehydration is inhibited by pyridine (heterocyclic organic compound, $C_5H_5N$), thus showing that pyridine is adsorbed on the acid sites, however the hydrogenation is not inhibited by pyridine, thus indicating that the catalyst e.g. TK-6001 HySwell at the above process conditions, will be able to convert aldehydes and ketones to alcohols using similar condition reactions with a real pyrolysis oil, which normally both contains organic sulfur and nitrogen.

The reaction scheme below shows the dehydration of 1-octanol to octene and subsequent hydrogenation to octane:

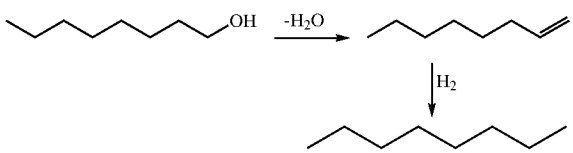

The reaction scheme below shows the hydrogenation of cyclopentanone (a cyclic ketone) to cyclopentanol, subsequent dehydration to cyclopentene and then hydrogenation to cyclopentane:

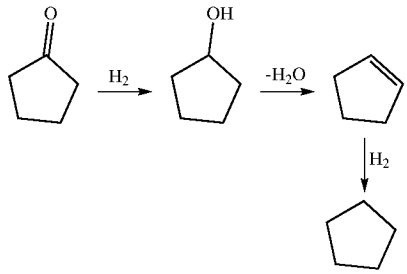

The conversion is defined as:

$$x = \left(1 - \frac{F_{outlet}}{F_{inlet}}\right) \times 100\%$$

where $F_{outlet}$ is the molar flow of the reactant out of the reactor and $F_{inlet}$ in the molar flow of the reactant into the reactor.

Yield for cyclopentanone's products is defined as:

$$y_i = \frac{n_{C,i} \times F_i}{x_{cyclopentanone}/100 \times F_{cyclopentanone,inlet} \times n_{C,cyclopentanone}}$$

Here $F_i$ the molar flow of product i out of the reactor and $n_{C,i}$ is the number of carbon atoms in product i.

Similarly, the yield of 1-octanols products is calculated as:

$$y_i = \frac{n_{C,i} \times F_i}{x_{1-octanol}/100 \times F_{1-octanol,inlet} \times n_{C,1-octanol}}$$

Example 4 shows the effect of carbonyl number on plugging of an actual pyrolysis oil. Table 5 shows the composition of the pyrolysis oil and Table 6 shows the test conditions and product composition. Stabilization reactor, reactor 1 (R1), was loaded with a stabilization catalyst as in Example 1 and thus according to the present invention. A downstream HDO reactor 2 (R2) was loaded with a) a medium-active catalyst having demetallization activity and moderate hydrodesulfurization activity, such as a commercial TK-743 catalyst, and b) a high-active hydrotreating catalyst, such as the high activity NiMo catalyst TK-611 HyBRIM™. No pressure drop was observed for any of the reactors during the first test conditions but decreasing the outlet temperature in R1 to 225° C. (condition 2) lead to plugging of R2 after additional 19 hours. The sample from the interstage (between R1 and R2), thus in the product stream from R1, showed that the carbonyl content had increased from 2.6 mol/kg in condition 1 to 3.9 mol/kg in condition 2, hence indicating that the increase in carbonyl content up to a certain threshold may be at least an indication for the coking of reactor, which lead to the undesired plugging. The increase in carbonyl number ratio or carbonyl content (carbonyl umber) may explain and could be the reason for the coking and thus plugging. The carbonyl number ratio (ratio of carbonyl number in feed to carbonyl number in product of R1) is suitably 1.7 or higher, such as here 1.9, and/or the carbonyl number is suitably decreased to below 3.0 in the stabilized liquid oil from the stabilization reactor in order to avoid plugging of the HDO reactor.

TABLE 5

| Feed composition of pyrolysis oil | | |
|---|---|---|
| Analysis | Method | |
| Oxygen (wt %) | Elemental analysis | 46 |
| Hydrogen (wt %) | D 7171 | 7.79 |
| Water (wt %) | Karl fischer titration | 21.3 |
| Carbonyl number (mol/kg) | ASTM E 3146 | 5.0 |
| Acid number (mg KOH/g) | ASTM D 664 | 79.7 |
| Sulfur (wt ppm) | ASTM D 5453 | 63 |
| Sulfur* (wt ppm) | ASTM D 5453 | 119 |
| Nitrogen (wt ppm) | ASTM D 4629 | 416 |
| SG @ 60/60° F. | ASTM D 4052 | 1.1997 |

*Sulfur content after doping

TABLE 6

| Test conditions and product composition | | | |
|---|---|---|---|
| Analysis | Method | Condition 1 | Condition 2 |
| Temperature, i.e. inlet temperature R1 (° C.) | | 100 | 100 |
| Outlet temperature R1 (° C.) | | 250 | 225 |
| Temperature, i.e. inlet temperature R2 (° C.) | | 250 | 250 |
| Outlet temperature R2 (° C.) | | 330 | 340 |
| Pressure (barg) | | 160 | 160 |
| H2/oil ratio (NL/L) | | 5075 | 5075 |
| LHSV R1 ($h^{-1}$) | | 0.11 | 0.11 |
| LHSV R2 ($h^{-1}$) | | 0.24 | 0.24 |
| Carbonyl number product from R1 (mol/kg) | ASTM E 3146 | 2.6 | 3.9 |
| Carbonyl number ratio, feed to product in R1 | | 1.9 | 1.3 |
| Sulfur (wt ppm) | ASTM D 5453 | 10 | 6 |
| Nitrogen (wt ppm) | ASTM D 4629 | 2.1 | 19 |
| SG @ 60/60° F. | ASTM D 4052 | 0.8710 | 0.8819 |
| SimDist | ASTM D 7500 | | |
| IBP (° C.) | | 83 | 100 |
| 50 wt % (° C.) | | 297 | 310 |
| 95 wt % (° C.) | | 536 | 550 |
| Time on stream (hours) | | 0-173 | 173-192* |

*Plugged after 192 hours due to plug in reactor 2.

The invention claimed is:

1. A process for hydrotreating a liquid oil stream by, in a continuous operation in a fixed bed reactor, reacting the liquid oil stream with hydrogen in the presence of a nickel-molybdenum (Ni—Mo) based catalyst at a temperature of 20-240° C., a pressure of 100-200 barg, a liquid hourly space velocity (LHSV) of 0.1-1.1 $h^{-1}$, and a hydrogen to liquid oil ratio, defined as the volume ratio of hydrogen to the flow of the liquid oil stream, of 1000-6000 NL/L, thereby forming a stabilized liquid oil stream; wherein a carbonyl number of the stabilized liquid oil stream is below 3.0 mol/kg, as measured by ASTM E 3146, and wherein a ratio of the carbonyl number of the liquid oil stream to a carbonyl number as measured by ASTM E 3146 in mol/kg of the stabilized liquid oil stream is monitored and maintained at 1.7 or higher.

* * * * *